US010053285B2

(12) United States Patent
Brown et al.

(10) Patent No.: US 10,053,285 B2
(45) Date of Patent: Aug. 21, 2018

(54) CONTAINER HANDLING APPARATUSES FOR REFUSE TRUCKS

(71) Applicant: BROWN INDUSTRIAL INCORPORATED, Botkins, OH (US)

(72) Inventors: Craig Donald Brown, Botkins, OH (US); Christopher Donald Brown, Botkins, OH (US)

(73) Assignee: BROWN INDUSTRIAL INCORPORATED, Botkins, OH (US)

( * ) Notice: Subject to any disclaimer, the term of this patent is extended or adjusted under 35 U.S.C. 154(b) by 0 days.

(21) Appl. No.: 15/393,688

(22) Filed: Dec. 29, 2016

(65) Prior Publication Data

US 2018/0186566 A1 Jul. 5, 2018

(51) Int. Cl.
*B65F 3/04* (2006.01)
*B65F 1/12* (2006.01)

(52) U.S. Cl.
CPC ..... *B65F 3/041* (2013.01); *B65F 1/122* (2013.01)

(58) Field of Classification Search
CPC ..... B65F 3/041; B65F 3/08; B65F 1/122
USPC ..... 414/409
See application file for complete search history.

(56) References Cited

U.S. PATENT DOCUMENTS 3,207,344 A * 9/1965 Clar ..... B60P 1/50 254/97
3,837,512 A 9/1974 Brown
4,113,125 A 9/1978 Schiller
4,450,828 A 5/1984 Onken et al.
4,670,227 A 6/1987 Smith
5,059,081 A 10/1991 Brown et al.
5,181,619 A 1/1993 Noble
5,690,465 A 11/1997 Ledwell
6,095,744 A 8/2000 Harrison
6,494,665 B1 * 12/2002 Bingman ..... B65F 3/08 414/409
6,884,017 B2 4/2005 Arrez et al.
6,921,239 B2 7/2005 Arrez et al.
6,929,441 B2 8/2005 Arrez et al.
(Continued)

OTHER PUBLICATIONS

Organic Waste Bodies and Trailers from http://brownindustrial.com/work/bucket-bodies-and-trailers/ available on Dec. 5, 2015 per archive.org. (Year: 2015).*

*Primary Examiner* — Mark C Hageman
(74) *Attorney, Agent, or Firm* — Dinsmore & Shohl LLP

(57) ABSTRACT

A cargo body of a refuse truck includes a support frame and a bed having a storage volume supported by the support frame. A container handling apparatus includes a primary lift arm for lifting a container lift platform using an actuation system. The primary lift arm is pivotally connected to the support frame at a pivot location between the support frame and the primary lift arm. The actuation system includes a hydraulic cylinder including an actuation rod that is used to move the primary lift arm between raised and lowered positions. A clevis member is connected at an end of the actuation rod. The clevis member has an arm link connection portion that pivotally connects to an arm linkage at a pivot location between the clevis member and the arm linkage and a traveler portion including a traveler member that moves along a guide track as the actuation rod is extended and retracted. The pivot location between the clevis member and the arm linkage is offset from the traveler member.

21 Claims, 8 Drawing Sheets

(56) References Cited

U.S. PATENT DOCUMENTS

| | | | | |
|---|---|---|---|---|
| 7,128,515 | B2 | 10/2006 | Arrez et al. | |
| 7,273,340 | B2 | 9/2007 | Arrez et al. | |
| 7,390,159 | B2 | 6/2008 | Rimsa et al. | |
| 7,806,645 | B2 | 10/2010 | Arrez et al. | |
| 7,871,233 | B2 | 1/2011 | Arrez et al. | |
| 8,246,824 | B2 | 8/2012 | Larin | |
| 2013/0302119 | A1* | 11/2013 | Steege ..... | B65F 3/08<br>414/409 |

* cited by examiner

CONTAINER HANDLING APPARATUSES FOR REFUSE TRUCKS

TECHNICAL FIELD

The present specification generally relates to refuse trucks and, more specifically container handling apparatuses for refuse trucks.

BACKGROUND

Refuse trucks may be used to collect and transport food waste, such as from the animal rendering industry or other separated food waste. Such food waste can be wet and heavy, which can provide unique challenges. A container handling apparatus may be used to move a platform or loader for large refuse truck containers from a position at ground level behind the refuse truck to a dumping compartment that is located behind a cab of the refuse truck and forward of a rear of the refuse truck. An "arm" mechanism may be used for handling the container platforms. U.S. Pat. No. 3,837,512, granted to Donald C. Brown on Sep. 24, 1974, for example, describes use of a pair of hydraulic cylinders to move a pair of vertically swingable arms of the mechanism.

Accordingly, a need exists for additional container handling apparatuses for use with refuse trucks.

SUMMARY

In one embodiment, a cargo body of a refuse truck includes a support frame and a bed having a storage volume supported by the support frame. A container handling apparatus includes a primary lift arm for lifting a container lift platform using an actuation system. The primary lift arm is pivotally connected to the support frame at a pivot location between the support frame and the primary lift arm. The actuation system includes a hydraulic cylinder including an actuation rod that is used to move the primary lift arm between raised and lowered positions. A clevis member is connected at an end of the actuation rod. The clevis member has an arm link connection portion that pivotally connects to an arm linkage at a pivot location between the clevis member and the arm linkage and a traveler portion including a traveler member that moves along a guide track as the actuation rod is extended and retracted. The pivot location between the clevis member and the arm linkage is offset from the traveler member.

In another embodiment, a refuse truck includes a cargo body including a support frame and a bed having a storage volume that is supported by the support frame. A container handling apparatus includes a primary lift arm for lifting a container lift platform using an actuation system. The primary lift arm is pivotally connected to the support frame at a pivot location between the support frame and the primary lift arm. The actuation system includes a hydraulic cylinder including an actuation rod that is used to move the primary lift arm between raised and lowered positions. A clevis member is connected at an end of the actuation rod. The clevis member has an arm link connection portion that pivotally connects to an arm linkage using a removable pin and a traveler portion comprising a traveler member that moves along a guide track as the actuation rod is extended and retracted. The removable pin is offset from the traveler member.

In another embodiment, a method of operating a container handling apparatus of a refuse truck is provided. The method includes engaging a user control to lower a container lift platform of the container handling apparatus. The container handling apparatus includes a primary lift arm for lifting a container lift platform using an actuation system. The primary lift arm is pivotally connected to a support frame of a cargo body at a pivot location between the support frame and the primary lift arm. The actuation system includes a hydraulic cylinder including an actuation rod that is used to move the primary lift arm between raised and lowered positions. A clevis member connected at an end of the actuation rod. The clevis member has an arm link connection portion that pivotally connects to an arm linkage using a removable pin and a traveler portion comprising a traveler member that moves along a guide track as the actuation rod is extended and retracted. The removable pin is offset from the traveler member. The user control is engaged to raise the container lift platform of the container handling apparatus using the hydraulic cylinder.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are generally related to refuse trucks that include a container handling apparatus. The refuse trucks may be generally of a type used in the rendering industry to collect and transport meat scraps and the like. The refuse trucks may include a frame that supports a cab and a bed that is located behind the cab. A container handling apparatus is provided at the bed that can be used to lift refuse containers from ground level to above the bed to deposit the refuse within the bed through a top bed opening.

The container handling apparatus includes an actuation system that moves a pair of primary lift arms between raised and lowered positions. The actuation system includes a hydraulic cylinder that is connected to a clevis member, which is in turn connected to an arm link at a pivot location. The clevis member includes a traveler member that travels along a guide rail. As will be described in greater detail below, the pivot location is offset from the traveler member as the traveler member moves within the guide rail to place the container handling apparatus in raised and lowered positions.

Figure 1:
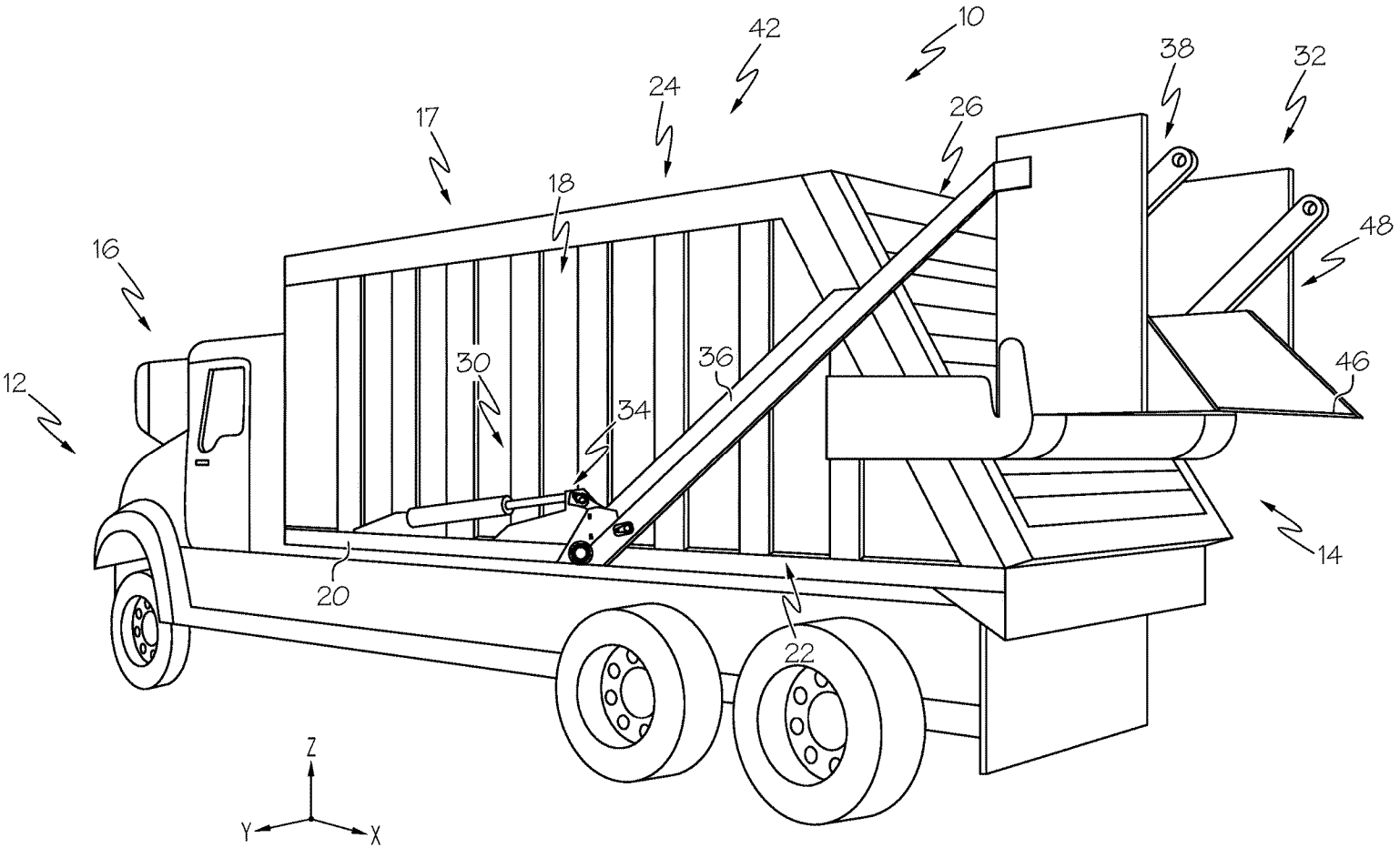
FIG. 1 illustrates a perspective view of a vehicle, according to one or more embodiments shown and described herein.

As used herein, the term "vehicle longitudinal direction" refers to the forward-rearward direction of the vehicle (i.e., in the +/− vehicle X-direction depicted in FIG. 1). The term "vehicle lateral direction" refers to the cross-vehicle direction (i.e., in the +/− vehicle Y-direction depicted in FIG. 1), and is transverse to the vehicle longitudinal direction. The term "vehicle vertical direction" refers to the upward-downward direction of the vehicle (i.e., in the +/− vehicle Z-direction depicted in FIG. 1). Further, the terms "inboard," "inward," "outboard" and "outward" are used to describe the relative positioning of various components of the vehicle. Referring to FIG. 1, the terms "outboard" or "outward" as used herein refers to the relative location of a component with respect to a vehicle centerline. The term "inboard" or "inward" as used herein refers to the relative location of a component with respect to the vehicle centerline. Because the vehicle structures may be generally symmetrical about the vehicle centerline, the direction to which use of terms "inboard," "inward," "outboard" and "outward" refer may be mirrored about the vehicle centerline when evaluating components positioned along opposite sides of the vehicle.

Referring to FIG. 1, a vehicle in the form of a refuse truck 10 includes a front 12, a rear 14, a cabin 16 and a cargo body 17 including a bed 18 located behind the cabin 16. In some embodiments, the bed may be fluid-tight and include a floor 20 that is supported on a support frame (generally referred to as element 22) and a top opening 24 through which refuse may be placed within a storage volume of the bed 18. A bed actuation mechanism is provided that can be used to position the bed 18 between raised and lowered positions. A tailgate 26 is provided that can be used to inhibit or allow removal (i.e., dumping) of refuse from the storage volume of the bed 18.

The refuse truck 10 further includes a container handling apparatus 30. The container handling apparatus 30 includes a container lift platform 32 that can be raised and lowered in order to place refuse from refuse containers within the storage volume of the bed 18. The container lift platform 32 is raised and lowered using an actuation system 34 that includes a pair of primary lift arms 36 and 38 that are pivotally connected to the container lift platform 32. The container lift platform 32 has a platform 46 and a volume 48 for holding refuse containers. The refuse containers can be, for example, loaded side-by-side on the platform 46, a process which is described in, for example, U.S. Pat. No. 5,059,081, granted on Oct. 22, 1991 and U.S. Pat. No. 3,857,503, granted on Dec. 31, 1974, the details of which are incorporated by reference as if fully set forth herein.

Figure 2:
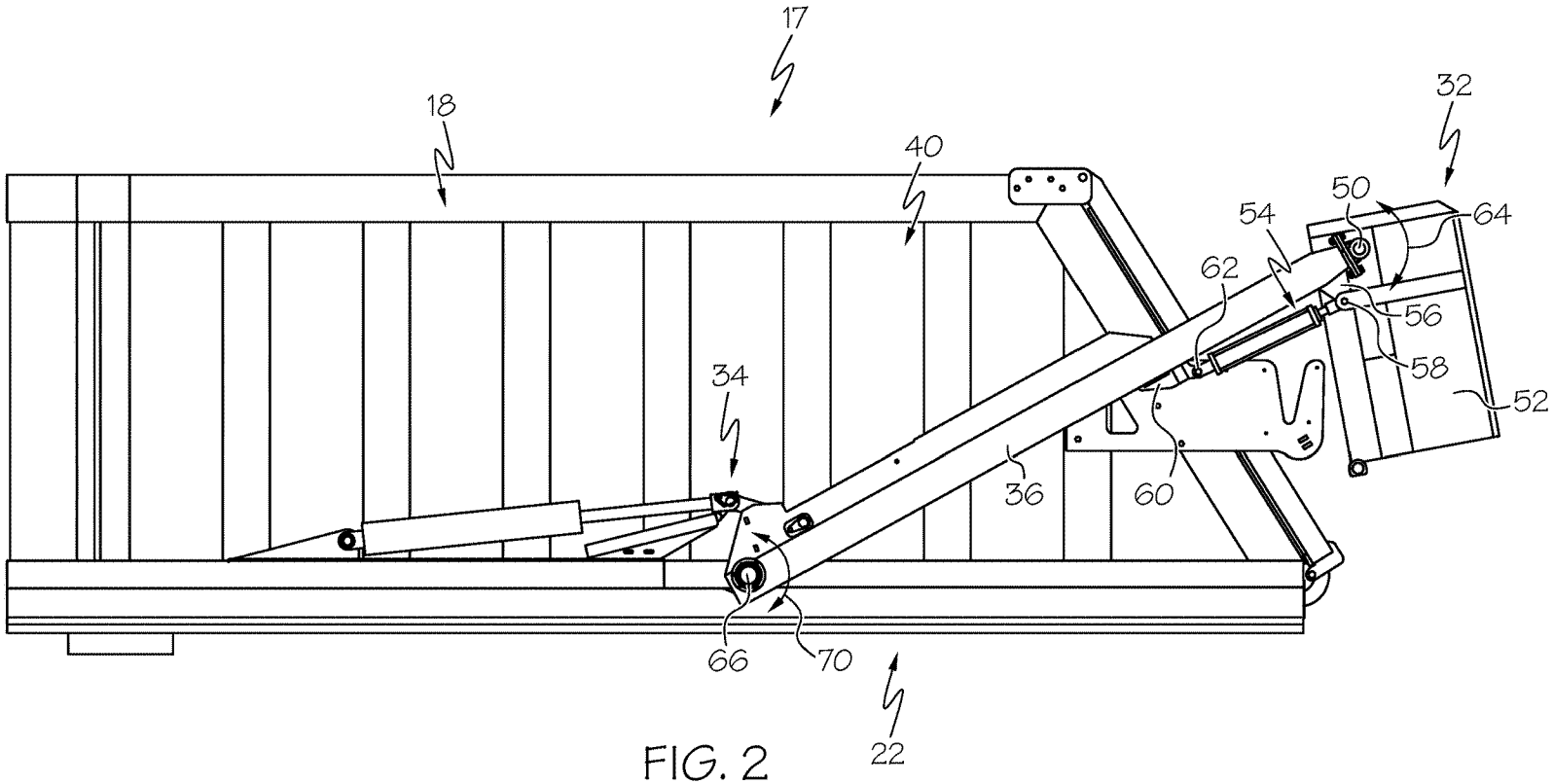
FIG. 2 illustrates a side view of a cargo body of the vehicle of FIG. 1 including a container handling apparatus, according to one or more embodiments shown and described herein.

FIG. 2 illustrates the cargo body 17 (e.g., of a semitrailer) including the bed 18 and the actuation system 34 in isolation and in greater detail with the actuation system 34 in an intermediate position. In the intermediate position, the container lift platform 32 is neither fully raised nor fully lowered. It should be noted that while only side 40 of the actuation system 34 is shown, the description of side 40 of the actuation system 34 may apply equally to the opposite side for a symmetric application of force to raise and lower the container lift platform 32 at opposite sides 40 and 42 (FIG. 1). The primary lift arm 36 is pivotally connected to the container lift platform 32 at a pivot location 50 located at a sidewall 52 of the container lift platform 32. A hydraulic cylinder 54 or other suitable actuator may be connected to the container lift platform 32 by a linkage 56 at an actuator rod end 58 that is offset from the pivot location 50 and also pivotally connected to the primary lift arm 36 via a fixed bracket 60 at a cylinder end 62. The actuator rod end 58 of the hydraulic cylinder 54 can be extended and retracted to controllably rotate the container lift platform 32 about the pivot location 50 in a pivot direction 64 to load and unload contents (e.g., refuse).

Figure 3:
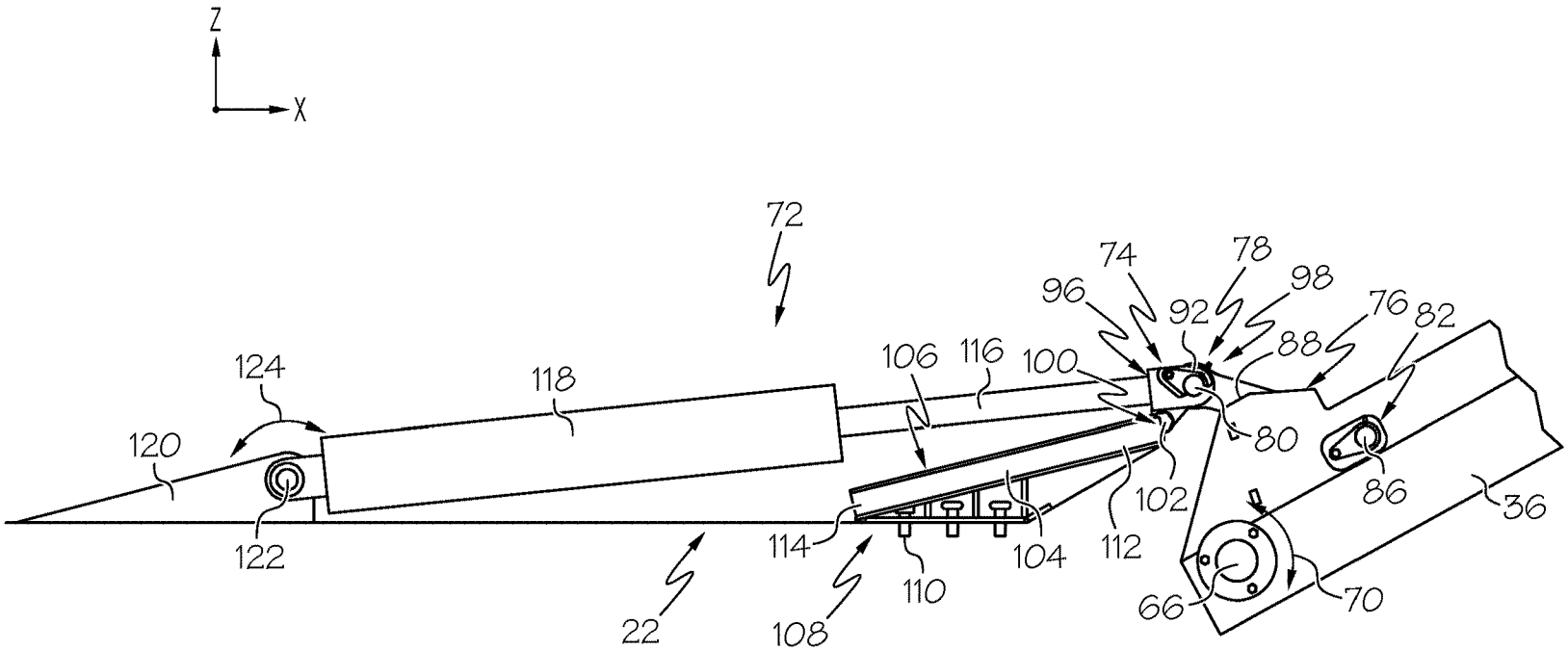
FIG. 3 illustrates a side view of the container handling apparatus of FIG. 2 in isolation, according to one or more embodiments shown and described herein.

The primary lift arm 36 is pivotally connected to the support frame 22 of the cargo body 17 at an arm pivot location 66. The primary lift arm 36 pivots about the pivot location 66 in a direction of arrow 70 between the raised and lowered positions. Referring now to FIG. 3 showing the actuation system 34 in greater detail, the primary lift arm 36 is moved using another hydraulic cylinder 72 or other suitable actuator. The hydraulic cylinder 72 may be pivotally connected to the primary lift arm 36 at an actuator rod end 74 by an arm linkage 76. In particular, the actuator rod end 74 may be pivotally connected to one end 78 of the arm linkage 76 at a pivot location 80 and the arm linkage 76 may, in turn, be connected at an opposite end 82 to the primary lift arm 36 at pivot location 86. The arm linkage 76 includes a link member 88. The link member 88 may be pivotally connected to the actuator rod end 74 by a removable pin 92. The removable pin 92 may be provided to readily disconnect the actuator rod end 74 and thus the hydraulic cylinder 72 from the primary lift arm 36.

The actuator rod end 74 may be connected to the arm linkage 76 using a clevis member 96. The clevis member 96 includes an arm link connection portion 98 and a traveler portion 100. The connection portion 98 has an opening extending therethrough for receiving the removable pin 92 thereby providing the pivot location 80. The traveler portion 100 includes a traveler member 102 (e.g., a roller wheel) that is received within a guide track 104 of a guide rail 106. The traveler portion 100 of the clevis member 96 may include a pair of traveler members 102 and 108 that travel along the guide track 104 of the guide rail 106.

As can be seen, the pivot location 80 and thereby the removable pin 92 are offset above the traveler member 102 in the vehicle vertical direction. The pivot location 80 and removable pin 92 may also be offset from the traveler member 102 in the vehicle longitudinal direction, rearward of the traveler member 102. Offsetting the pivot location 80 and the removable pin 92 from the traveler member 102 in the vehicle vertical direction maintains a spaced arrangement between the pivot location 80 and the removable pin 92. Such a spaced arrangement can expose the removable pin 92 above the guide rail 106 and guide track 104 to facilitate removal of the removable pin 92 from the arm linkage 76 at various locations along a length of the guide rail 106 and without any need for removing the traveler member 102 from the guide track 104.

The guide rail 106 is fixedly connected to the support frame 22 using guide rail base structure 108 and fastener members 110 and/or any other suitable connection, such as welding. The guide rail base structure 108 supports the guide rail 106 in an inclined fashion with a rearward end 112 being at a higher elevation than a forward end 114. Such an inclined arrangement of the guide rail 106 and guide track 104 continuously changes a position of the pivot location 80, which can provide a greater range of motion (i.e., angle of rotation) for the primary lift arm 36 for a given stroke length of actuator rod 116 into and out of cylinder member 118.

The hydraulic cylinder 72 is pivotally connected to the support frame 22 via a fixed bracket 120 at a cylinder end 122. The fixed bracket 120 may be fixed to the support frame using any suitable connection, such as fasteners, welding, etc. The hydraulic cylinder 72 may be pivotally connected to the fixed bracket 120 at a pivot location 122 that allows the hydraulic cylinder 72 to rotate in a direction of arrow 124 as the actuator rod 116 is extended and retracted and the traveler member 102 of the clevis member 96 rides within the guide track 104 of the guide rail 106. The fixed bracket 120 also maintains a fixed point for the hydraulic cylinder 72 in the vehicle longitudinal direction during operation.

Figure 4:
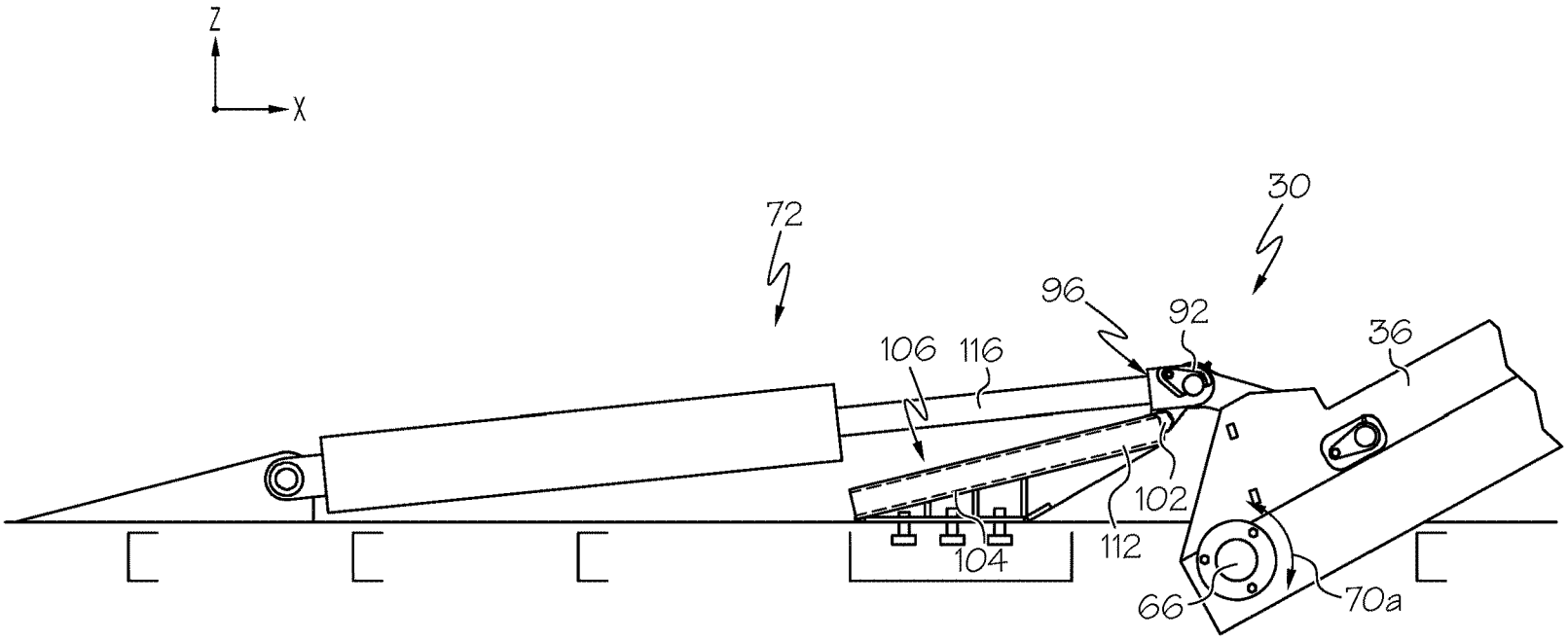
FIG. 4 illustrates another side view of the container handling apparatus of FIG. 3 in operation, according to one or more embodiment shown and described herein.
Figure 4A:
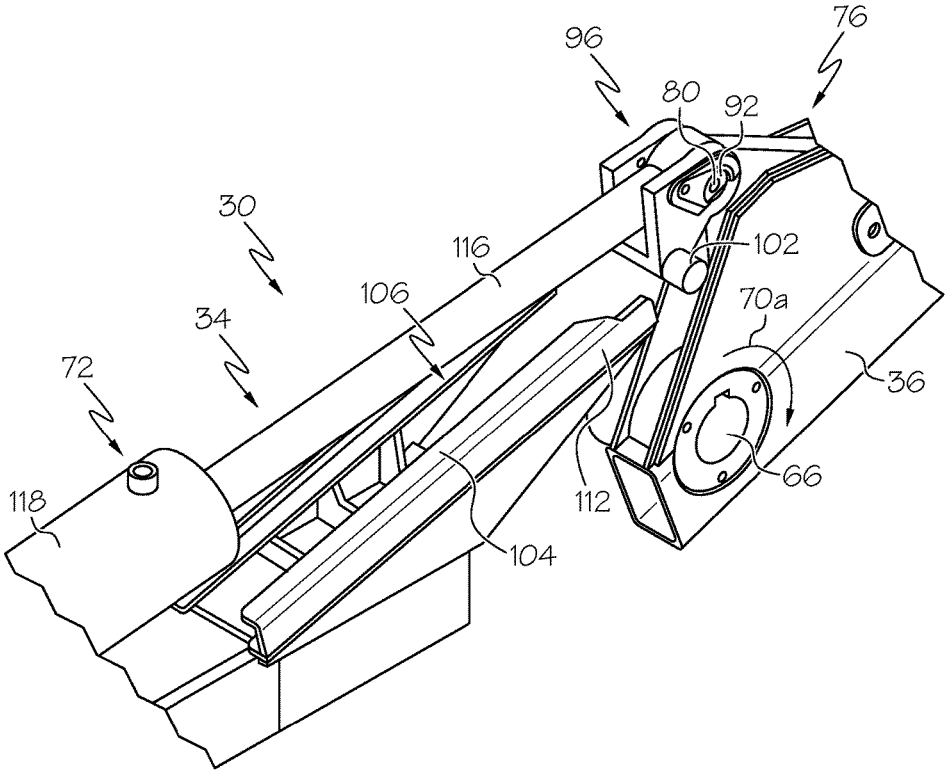
FIG. 4A is a detail, perspective view of the container handling apparatus of FIG. 4.
Figure 5:
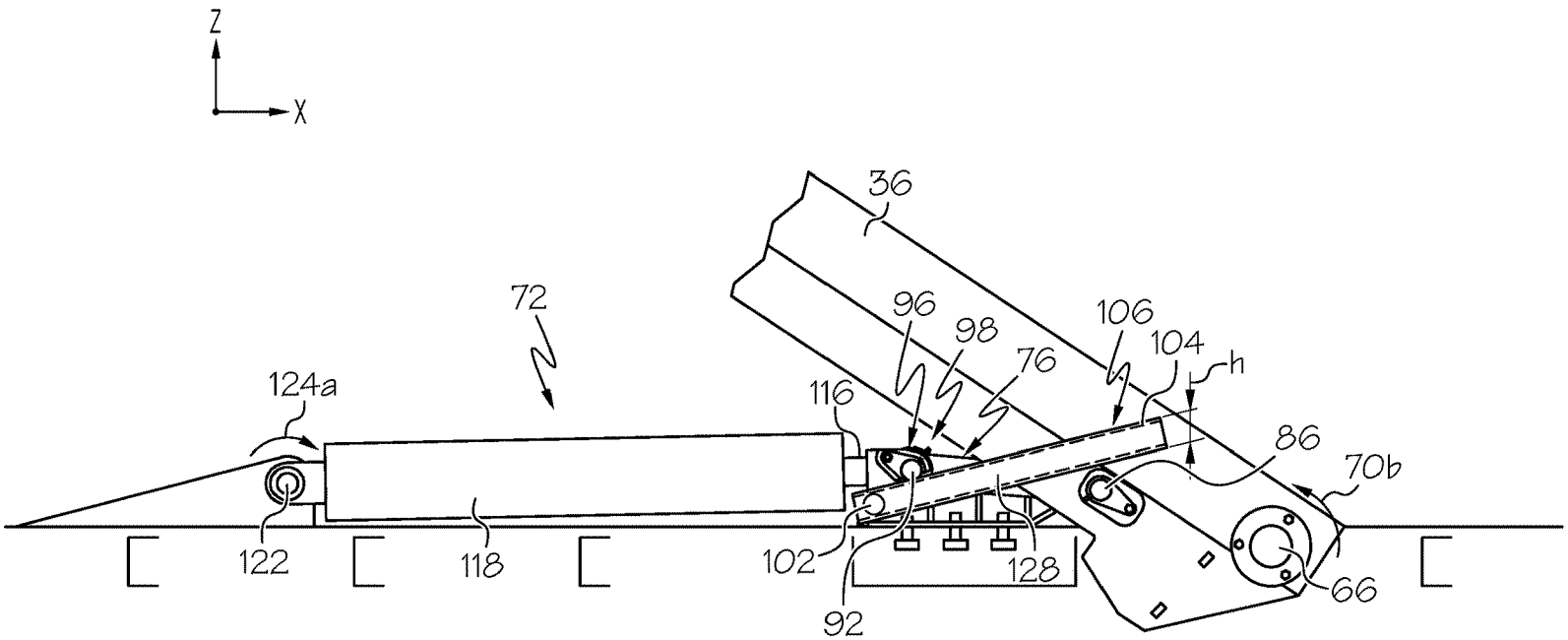
FIG. 5 illustrates another side view of the container handling apparatus of FIG. 3 in operation, according to one or more embodiments shown and described herein.

FIGS. 4, 4A, 5 and 5A illustrate operation of the container handling apparatus 30 and actuation system 34 in a relatively lowered position (FIG. 4) and a relatively raised position (FIG. 5). Referring first to FIGS. 4 and 4A, as can be seen, the primary lift arm 36 is rotated in the direction 70*a* about the pivot location 66 to the illustrated lowered position with the actuator rod 116 of the hydraulic cylinder 72 in an extended position. With the actuator rod 116 of the hydraulic cylinder 72 in the extended position, the traveler member 102 of the clevis member 96 is located at the rearward end 112 of the guide rail 106. As can be seen, the pivot location 80 and the removable pin 92 are located offset from the traveler member 102 and the guide rail 106 thereby exposing the removable pin 92 outside the guide track 104.

Figure 5A:
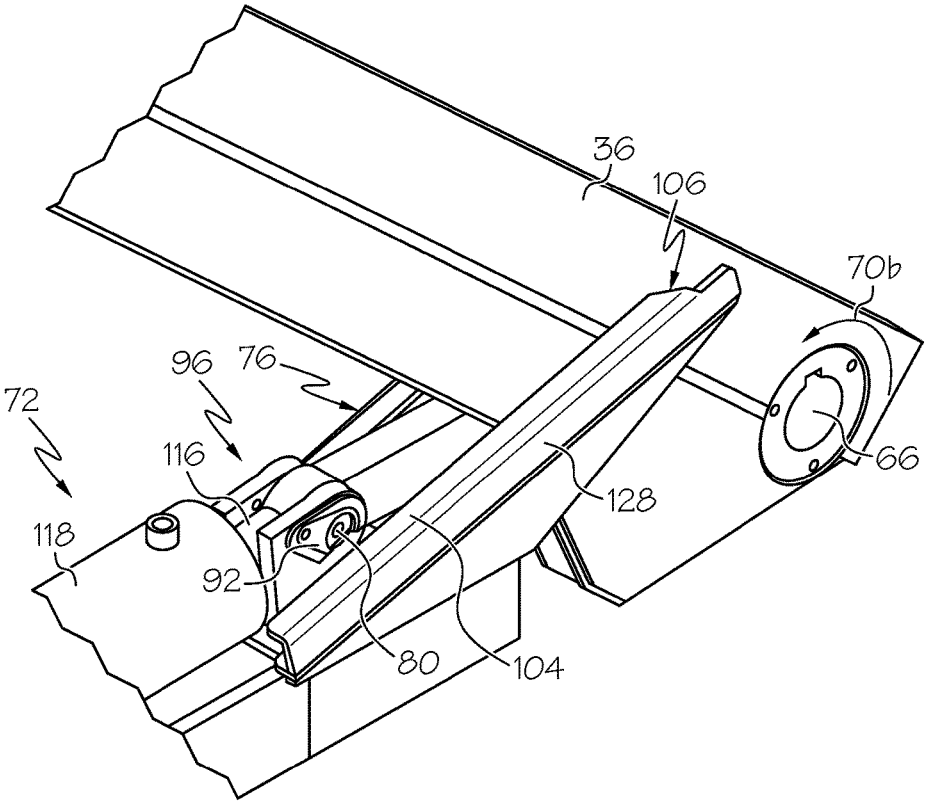
FIG. 5A is a detail, perspective view of the container handling apparatus of FIG. 5.

Referring to FIGS. 5 and 5A, in the raised position, the primary lift arm 36 is rotated in the direction 70*b*, which lifts the container lift platform 32 (FIGS. 1 and 2) in the vehicle vertical and longitudinal directions above the bed 18. As the actuator rod 116 is retracted into the cylinder member 118, the clevis member 96 moves forward in the vehicle longitudinal direction and also downward in the vehicle vertical direction due to the ramped orientation of the guide track 104. In some embodiments, the traveler member 102 is a roller wheel that rolls along the guide track 104 to facilitate movement of the traveler member 102 along the guide track 104.

As the traveler member 102 moves along the guide track 104, the arm linkage 76 moves forward in the vehicle longitudinal direction and also downward in the vehicle vertical direction due to the pivotal connection to the clevis member 96 at the pivot location 80. Because the pivot location 80 is provided by the clevis member 96, the pivot location 80 moves linearly down the guide track 104 with retraction of the actuator rod 116. The hydraulic cylinder 72 also rotates downward in the vehicle vertical direction in the direction of arrow 124a about the pivot location 122. As can be appreciated, the arm linkage 76 moves forward in the vehicle longitudinal direction and downward in the vehicle vertical direction with movement of the clevis member 96 and retraction of the actuator rod 116.

To accommodate the movement of the arm linkage 76, the primary lift arm 36 rotates in the direction of the arrow 70*b* about the pivot location 66 toward the raised position. The pivot location 86, being located on the primary lift arm 36, orbits around the pivot location 66 as the primary lift arm 36 rotates. Thus, the arm linkage 76 transfers force from the hydraulic cylinder 72 to the primary lift arm 36 to arrive at the raised position illustrated by FIGS. 5 and 5A. Referring briefly back to FIG. 2, in the raised position, the hydraulic cylinder 54 may be used to pivot the container lift platform 32 to unload contents, such as refuse.

Referring again to FIGS. 5 and 5A, in some embodiments, the guide rail 106 may have a height h that inhibits removal of the removable pin 92 with the arm link connection portion 98 of the clevis member 96 retracted into the guide track 104 of the guide rail 106. As can be seen by FIG. 5, a sidewall 128 of the guide rail 106 may be sized in height h to cover at least a portion of the removable pin 92 with the clevis member 96 in a retracted location along the guide track 104. As can be seen by FIGS. 4 and 4A, with the actuator rod 116 in the extended position, the removable pin 92 is spaced from the guide rail 106 due to the offset arrangement of the removable pin 92 from the traveler member 102. Such an arrangement can inhibit removal of the removable pin 102 with the primary lift arm 36 in a raised position.

Figure 6:
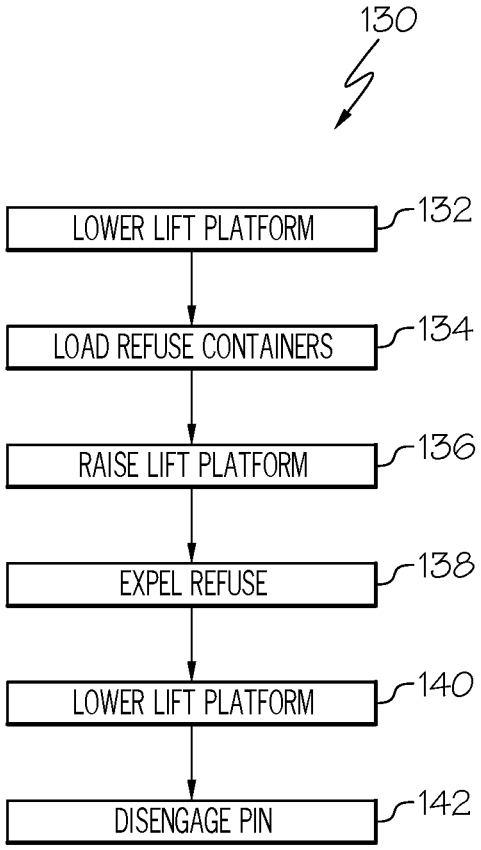
FIG. 6 depicts a method of operating the container handling apparatus of FIG. 3, according to one or more embodiments shown and described herein.

Referring to FIG. 6, a method 130 of operating the container handling apparatus including the actuation system is shown. At step 132, the operator may engage a user control located inside the cabin of the refuse truck or outside the cabin of the refuse truck to lower the container lift platform to ground level in the fully lowered position by extending the actuator rod of the hydraulic cylinder, as described above, causing the primary lift arm to rotate. Refuse containers containing refuse may be loaded onto the container lift platform and secured thereto at step 134. At step 136, the operator may then engage the user control to lift the container lift platform and the refuse containers from the ground by retracting the actuator rod of the hydraulic cylinder, as described above, causing the primary lift arm to rotate in the opposite direction. At step 138, the operator may again access the user control to cause the hydraulic cylinder attached to the container lift platform to extend, thereby rotating the container lift platform to expel refuse from the container lift platform. The operator may then again access the control panel to cause the hydraulic cylinder to extend the actuator rod to place the container handling apparatus in a lowered or intermediate position at step 140. At step 142, the removable pin may be disengaged or removed from the clevis member in order to disengage the hydraulic cylinder from the primary lift arm, as discussed above.

The above-described container handling apparatuses provide an actuation system for moving the primary lift arms between lowered and raised positions. The actuation system uses a clevis member having an arm link connection portion that is offset from a traveler portion. Such an offset arrangement can also offset the releasable pin and associated pivot location from the traveler member and the guide rail, which can facilitate removable of the removable pin and disconnecting of the hydraulic cylinder from the primary lift arms. Any of the pins shown and described herein that provide pivot locations can be removable like removable pin 92.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A cargo body of a refuse truck, comprising:

a support frame;

a bed having a storage volume supported by the support frame;

a container handling apparatus comprising a primary lift arm for lifting a container lift platform using an actuation system, the primary lift arm being pivotally connected to the support frame at a pivot location between the support frame and the primary lift arm, the actuation system comprising:

a hydraulic cylinder comprising an actuation rod that is used to move the primary lift arm between raised and lowered positions; and a clevis member connected at an end of the actuation rod, the clevis member having an arm link connection portion that pivotally connects to an arm linkage at a pivot location between the clevis member and the arm linkage, the arm linkage being connected to the primary lift arm, and a traveler portion comprising a traveler member that moves along a guide track as the actuation rod is extended and retracted, the pivot location between the clevis member and the arm linkage being offset from the traveler member in at least one of a vehicle vertical direction and a vehicle longitudinal direction.

2. The cargo body of claim 1, wherein the arm linkage is connected to the primary lift arm at a pivot location between the arm linkage and the primary lift arm.

3. The cargo body of claim 1 comprising a guide rail that is fixedly connected to the support frame, the guide rail including the guide track, wherein the pivot location between the clevis member and the arm linkage is at least partially exposed outside of the guide rail.

4. The cargo body of claim 3, wherein the guide track is ramp-shaped having a rearward end that is elevated in a vehicle vertical direction relative to a forward end.

5. The cargo body of claim 1, wherein the traveler member comprises a roller wheel.

6. The cargo body of claim 1, wherein a removable pin is located at the pivot location between the clevis member and the arm linkage.

7. The cargo body of claim 1 further comprising a container lift platform pivotally connected to the primary lift arm.

8. The cargo body of claim 1, wherein the hydraulic cylinder comprises a first end connected to the clevis member and a second end connected to the support frame.

9. A refuse truck comprising:

a cargo body comprising a support frame and a bed having a storage volume that is supported by the support frame;

a container handling apparatus comprising a primary lift arm for lifting a container lift platform using an actuation system, the primary lift arm being pivotally connected to the support frame at a pivot location between the support frame and the primary lift arm, the actuation system comprising:

a hydraulic cylinder comprising an actuation rod that is used to move the primary lift arm between raised and lowered positions; and a clevis member connected at an end of the actuation rod, the clevis member having an arm link connection portion that pivotally connects to an arm linkage using a removable pin, the arm linkage being connected to the primary lift arm, and a traveler portion comprising a traveler member that moves along a guide track as the actuation rod is extended and retracted, the removable pin being offset from the traveler member in at least one of a vehicle vertical direction and a vehicle longitudinal direction.

10. The refuse truck of claim 9, wherein the arm linkage is connected to the primary lift arm at a pivot location between the arm linkage and the primary lift arm.

11. The refuse truck of claim 9 comprising a guide rail that is fixedly connected to the support frame, the guide rail including the guide track.

12. The refuse truck of claim 11, wherein the guide track is ramp-shaped having a rearward end that is elevated in a vehicle vertical direction relative to a forward end.

13. The refuse truck of claim 9, wherein the traveler member comprises a roller wheel.

14. The refuse truck of claim 9, wherein the removable pin is located at a pivot location between the clevis member and the arm linkage.

15. The refuse truck of claim 9 further comprising a container lift platform pivotally connected to the primary lift arm.

16. A method of operating a container handling apparatus of a refuse truck, the method comprising:

engaging a user control to lower a container lift platform of the container handling apparatus, the container handling apparatus comprising a primary lift arm for lifting a container lift platform using an actuation system, the primary lift arm being pivotally connected to a support frame of a cargo body at a pivot location between the support frame and the primary lift arm, the actuation system comprising:

a hydraulic cylinder comprising an actuation rod that is used to move the primary lift arm between raised and lowered positions; and a clevis member connected at an end of the actuation rod, the clevis member having an arm link connection portion that pivotally connects to an arm linkage using a removable pin, the arm linkage being connected to the primary lift arm, and a traveler portion comprising a traveler member that moves along a guide track as the actuation rod is extended and retracted, the removable pin being offset from the traveler member in at least one of a vehicle vertical direction and a vehicle longitudinal direction; and engaging the user control to raise the container lift platform of the container handling apparatus using the hydraulic cylinder.

17. The method of claim 16, wherein the arm linkage is connected to the primary lift arm at a pivot location between the arm linkage and the primary lift arm.

18. The method of claim 16, wherein the actuation system further comprises a guide rail that is fixedly connected to the support frame, the guide rail including the guide track.

19. The method of claim 18, wherein the guide track is ramp-shaped having a rearward end that is elevated in a vehicle vertical direction relative to a forward end.

20. The method of claim 16, wherein the traveler member comprises a roller wheel.

21. The method of claim 16, further comprising removing the removable pin with the traveler member located on the guide track.

* * * * *